US005281906A

United States Patent [19]

Thelen, Jr.

[11] Patent Number: 5,281,906

[45] Date of Patent: Jan. 25, 1994

[54] TUNABLE VOLTAGE REFERENCE CIRCUIT TO PROVIDE AN OUTPUT VOLTAGE WITH A PREDETERMINED TEMPERATURE COEFFICIENT INDEPENDENT OF VARIATION IN SUPPLY VOLTAGE

[75] Inventor: Donald C. Thelen, Jr., Pullman, Wash.

[73] Assignee: Lattice Semiconductor Corporation, Hillsboro, Oreg.

[21] Appl. No.: 785,442

[22] Filed: Oct. 29, 1991

[51] Int. Cl.[5] ..... G05F 3/24

[52] U.S. Cl. ..... 323/313; 323/314; 323/907; 307/296.1; 307/296.6; 307/296.8

[58] Field of Search ..... 323/313, 314, 907; 307/296.1, 296.6, 296.8

[56] References Cited

U.S. PATENT DOCUMENTS 4,833,342 5/1989 Kiryu et al. ..... 323/313 X
5,109,187 4/1992 Guliani ..... 323/313

OTHER PUBLICATIONS

Article entitled "A Floating CMOS Bandgap Reference Voltage for Differential Applications", by M. Ferro et al., published in the IEEE Journal of Solid State Circuits, vol. SC-24, pp. 690-697.

Article entitled "A New NMOS Temperature-Stable Voltage Reference" by R. Blauschild et al., published in the IEEE Journal of Solid-State Circuits, vol. SC-13, pp. 767-773, Dec. 1978.

Pp. 736-737 from the book entitled *Analysis and Design of Analog Integrated Circuits*, second edition, by P. R. Gray and R. E. Meyer, published by John Wiley and Sons, New York, N.Y., 1984.

*Primary Examiner*—Emanuel T. Voeltz
*Attorney, Agent, or Firm*—Skjerven, Morrill, MacPherson, Franklin & Friel

[57] ABSTRACT

A voltage reference circuit for providing a predetermined reference voltage at an output terminal which is independent of variation in supply voltage. The voltage reference circuit includes first and second semiconductor elements coupled between supply voltage terminals of a power supply, with the first and second semiconductor elements being connected in series with first and second impedances. The reference voltage is provided at the common terminal of the first and second impedances. The temperature coefficient of voltages produced by the first and second semiconductor elements in combination with the first and second impedances provide a reference voltage with a predetermined temperature coefficient. A tuning circuit is also included to permit fine adjustment of voltage level changes due to process variations.

24 Claims, 2 Drawing Sheets

TUNABLE VOLTAGE REFERENCE CIRCUIT TO PROVIDE AN OUTPUT VOLTAGE WITH A PREDETERMINED TEMPERATURE COEFFICIENT INDEPENDENT OF VARIATION IN SUPPLY VOLTAGE

BACKGROUND OF THE INVENTION

1. Field of the Invention

This invention relates to voltage reference circuits for providing a constant reference voltage as an output from the circuit, and more particularly, to a voltage reference circuit utilizing the differences in threshold voltage changes with temperature based on a depletion mode MOSFET transistor and an enhancement mode MOSFET transistor.

2. Description of the Prior Art

In the prior art several techniques have been utilized to produce a voltage reference from a power supply subject to variations in voltage and temperature, however none of the techniques have been totally successful. One technique which has been utilized is a voltage divider which is connected across the power supply and the reference voltage is taken from a tap on the voltage divider. This arrangement is not satisfactory for variations in the supply voltage.

A second technique known in the prior art is the utilization of bandgap techniques utilizing bipolar transistors. This type of voltage reference is described in an article entitled "A Floating CMOS Bandgap Reference Voltage for Differential Applications" by M. Ferro et al. in the IEEE Journal of Solid State Circuits, Vol. SC-24, pp. 690–697, June, 1989. Although this type of circuit provides an accurate voltage reference which can be built on a CMOS chip, it is often not used on a CMOS chip because the substrate currents caused by the bipolar transistors may be unacceptable.

A third voltage reference circuit known in the prior art is based on the use of the difference between the threshold voltages of depletion mode and enhancement mode field effect transistors. However, this technique utilizes a circuit which does not permit fine adjustment of the voltage reference value and complete temperature compensation is not possible. A circuit of this type is described in an article entitled "A New NMOS Temperature-stable Voltage Reference" by R. Blauschild, in the IEEE Journal of Solid-State Circuits, Vol. SC-13, pp. 767–773, December 1978. The circuit described in Blauschild et al. is not economically feasible for 5 volt power supplies because special processing of the devices used in the voltage reference circuit is required. The threshold voltage difference in the Blauschild et al. circuitry may be larger than the power supply voltage in some applications, rendering the circuit useless for the application.

SUMMARY OF THE INVENTION

An object of the present invention is to provide a voltage reference circuit which produces a reference voltage with a predetermined temperature coefficient at an output which is independent of variations in the magnitude of a supply voltage (for variations both above and below the normal supply voltage magnitude) applied to the voltage reference circuit.

Another object of the present invention is to provide a circuit which receives the reference voltage having a predetermined temperature coefficient and produces a tunable output voltage having a magnitude which is a function of programmable circuit elements.

In accordance with another object of the present invention, the programmable circuit elements are programmable and reprogrammable to permit changing the circuit characteristics as may be required for optimization of the tunable output voltage provided by the circuit.

In accordance with the present invention a voltage reference circuit is provided for producing a reference voltage having a predetermined temperature coefficient wherein the value of the reference voltage is independent of supply voltage variation, the voltage reference circuit comprising a depletion mode transistor, first and second resistors, and an N-channel enhancement mode transistor all series connected between supply voltage terminals for receiving a supply voltage. The reference voltage is provided at the common connection between the first and second resistors. The temperature coefficient of the threshold voltage of the depletion mode transistor and the temperature coefficient of the N-channel enhancement mode transistor are used to counteract each other, thereby providing offsetting changes for temperature variations. The first and second resistors provide the ability to fine tune this offsetting change in order to achieve a reference voltage with a predetermined temperature coefficient.

In accordance with another feature of the present invention, tunability of the reference voltage output is achieved by providing an voltage gain stage coupled to a voltage divider. Switchable connections between the nodes in the voltage divider and further output terminals provides the ability to have a final output which is equal to, less than, or greater than the reference voltage provided by the above-mentioned circuit.

BRIEF DESCRIPTION OF THE DRAWINGS

Other objects and advantages of the present invention will become apparent from the study of the Specification and drawings in which.

DETAILED DESCRIPTION OF THE INVENTION

Figure 1:
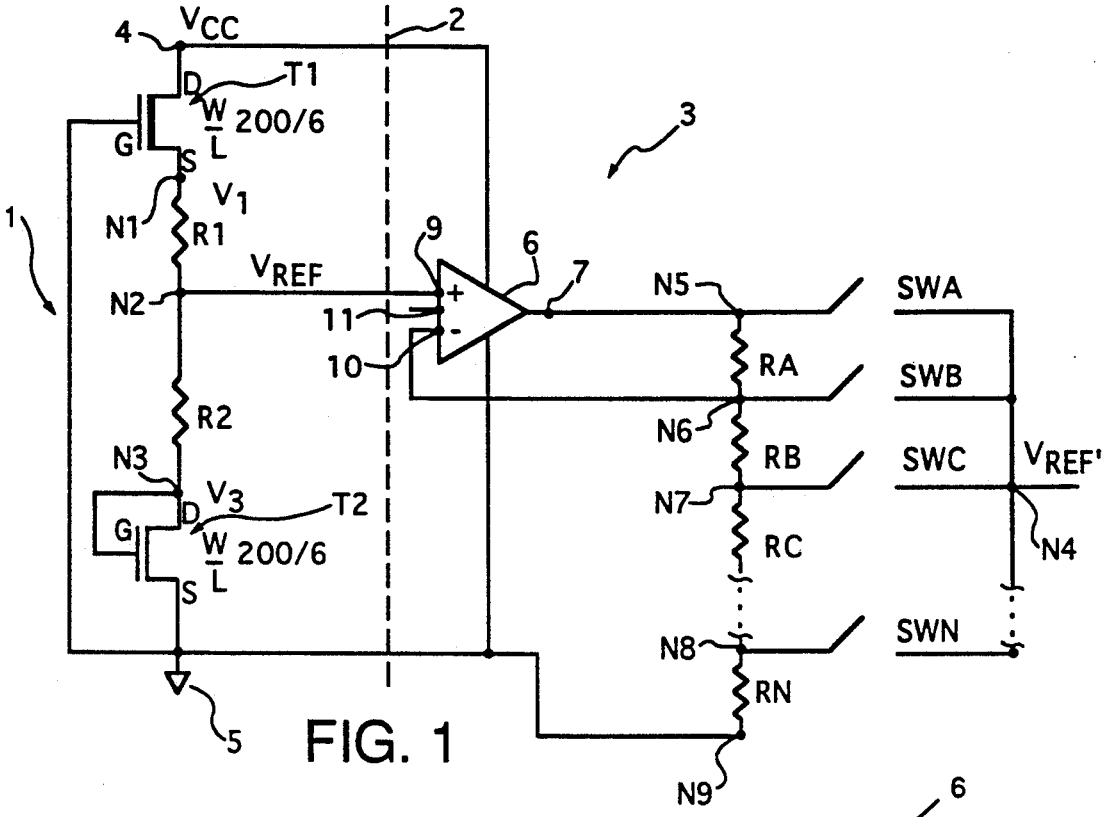
FIG. 1 is a circuit diagram of one embodiment of a voltage re circuit in accordance with the present invention.

Referring to FIG. 1, voltage reference circuit 1 in accordance with the present invention is illustrated, and comprises the circuitry to the left of dashed line 2. Reference voltage $V_{REF}$ is provided in node N2 which is the common connection between resistors R1 and R2. To provide further flexibility in the magnitude of the output voltage available, tuning of the output voltage, tuning circuit 3 is coupled between node N2 and node N4, to provide at node N4 an output voltage $V_{REF}$. Utilizing tuning circuit 3 permits further control of the available output voltage and permits fine tuning of the magnitude of the output voltage to provide a $V_{REF}$ which can be equal to, greater than or less than $V_{REF}$.

Referring to FIG. 1, voltage reference circuit 1 includes terminal 4 to which a positive supply voltage $V_{CC}$ is applied and terminal 5 which may be considered the common ground reference for supply voltage $V_{CC}$. It is desired to have two voltages with opposite temperature coefficients which are summed through two resistors to produce a voltage with a predetermined temperature coefficient at node N2, which is between the temperature coefficient of the two voltages. This is achieved by rationing the values of the two resistors to provide a weighted sum of the two independent temperature coefficients. In the absence of voltages with appropriate temperature coefficients, enhancement and depletion MOSFET transistors can be used to provide voltages at nodes N1 and N3 with appropriate temperature coefficients with a minimum number of devices. Other semiconductor elements or circuits could be used to provide voltages with appropriate temperature coefficients. For example, a P-channel device could be used in place of T2.

The threshold voltages of two transistor types (N-channel enhancement and depletion) can be used to satisfy the requirement of providing two voltages with opposite temperature coefficients ($V_{TN}$, $V_{TD}$). Voltages which are substantially equal to these threshold voltages ($V_{TN}$, $V_{TD}$) can be achieved by operating the transistors in a "slightly on" mode such that $V_{GS} \cong V_T$ for both the N-channel enhancement and depletion transistors. The following formulas illustrate how the gate to source voltage ($V_{GS}$) may be made approximately equal to the threshold voltage ($V_T$) of the device.

$$I_{DS} = \left(\frac{\mu Cox}{2}\right)\frac{W}{L}(V_{GS} - V_T)^2 \quad [1]$$

$$(V_{GS} - V_T)^2 = \frac{I_{DS}}{\frac{\mu Cox}{2}\left(\frac{W}{L}\right)} = \left(\frac{1}{\mu Cox}\right)\left(\frac{2I_{DS}L}{W}\right) \quad [2]$$

$$V_{GS} - V_T = \sqrt{\left(\frac{1}{\mu Cox}\right)\left(\frac{2I_{DS}L}{W}\right)} \quad [3]$$

$$V_{GS} = \sqrt{\left(\frac{1}{\mu Cox}\right)\left(\frac{2I_{DS}L}{W}\right)} + V_T \quad [3]$$

Therefore, $V_{GS} \approx V_T$ if the term in the square root portion of the equation is small with respect to the value of $V_T$.

$\mu$: Constant—hole and electron mobility $$\left(\frac{cm^2}{V \cdot S}\right)$$

Cox: Constant—gate oxide capacitance per unit area

By making $$\left(\frac{I_{DS}L}{W}\right)$$

small, we can make $V_{GS} \approx V_T$.

A) Low $I_{DS}$ is defined by appropriate choice of R1 and R2.

B) Large W/L ratio issued to achieve the following relationship $$\left(\frac{I_{DS}L}{W}\right) \approx 100 \times 10^{-9} A$$

is a reasonable target value.

The circuit compensation of FIG. 1 is self-biasing and serves to produce two voltages which are approximately equal to the threshold voltages ($V_{TN}$, $V_{TD}$) and have opposite temperature coefficients. In the circuit of FIG. 1 $V_1 = -V_{TD}$ and $V_3 = V_{TN}$. Both the $V_1$ and the $V_3$ are independent of $V_{CC}$ to a first order for $V_{CC} \geqq -V_{TD}$ (approximately equal to 2.7 v).

Transistors T1 and T2 should operate as close to turn-on as possible so that $V_{GS}$ is approximately equal to $V_T$ for both transistors. Therefore, as temperature changes affect $V_{TD}$ and $V_{TN}$, the voltage changes reflected on nodes N1 and N3 are substantially due to the changes in $V_{TD}$ and $V_{TH}$.

As will be appreciated by reference to FIG. 1, N-channel enhancement mode transistor T2 includes drain, source and gate terminals, with the drain terminal being connected to node N3, the source terminal being connected to terminal 5 (the common reference for supply voltage $V_{CC}$), and the gate being connected to node N3. Voltage V3 appearing at node N3 is substantially equal to the threshold voltage $V_{TN}$ of transistor T2.

The value for reference voltage $V_{REF}$ may be derived as follows.

$$V_{REF} = V_3 + \left(\frac{R2}{R1 + R2}\right)(V_1 - V_3) \quad [5]$$

Since $V_1 \approx -V_{TD}$ and $V_3 \approx V_{TN}$ $$= V_{TN} + \left(\frac{R2}{R1 + R2}\right)(-V_{TD} - V_{TN}) \quad [6]$$

$$= V_{TN} - \left(\frac{R2}{R1 + R2}\right)(V_{TD}) - \frac{R2}{R1 + R2}(V_{TN}) \quad [7]$$

$$= \left(\frac{R1 + R2}{R1 + R2} - \frac{R2}{R1 + R2}\right)V_{TN} - \frac{R2}{R1 + R2}(V_{TD}) \quad [8]$$

$$= \frac{R1}{R1 + R2}V_{TN} - \frac{R2}{R1 + R2}(V_{TD}) \quad [9]$$

Now including the threshold voltage temperature coefficients:

$$= \frac{R1}{R1 + R2}V_{TN}(1 + \alpha_2 T) - \frac{R2}{R1 + R2}(V_{TD})(1 + \alpha_1 T) \quad [10]$$

$$= \underbrace{\left[\frac{R1}{R1 + R2}(V_{TN}) - \frac{R2}{R1 + R2}(V_{TD})\right]}_{\text{ABSOLUTE VALUE TERM}} + \left[\frac{R1}{R1 + R2}(V_{TN}\alpha_2) - \frac{R2}{R1 + R2}(V_{TD}\alpha_1)\right]T \quad [11]$$

-continued $$\xleftrightarrow{\text{TEMPERATURE COEFFICIENT}}$$

In the above formula, $\alpha_1$ is the temperature coefficient for the threshold voltage of transistor T1 and $\alpha_2$ is temperature coefficient for the threshold voltage of transistor T2. An appropriate resistance value for R1 and R2 is selected to provide a ratio R1/R2 to provide a value for $V_{REF}$ with a predetermined temperature coefficient over a wide temperature range. Accordingly, in the last expression above, $\alpha_1$ and $\alpha_2$ are utilized to fully describe the formula for calculating $V_{REF}$ taking into consideration temperature changes.

Equation [11] has two terms, one representative of the absolute value of the voltage reference ($V_{REF}$), and one representative of the variation in $V_{REF}$ due to variation in temperature. If so desired, a $V_{REF}$ with a zero temperature coefficient can be achieved when the temperature coefficient term is equal to zero. This occurs when $$\frac{R_1}{R_1 + R_2}(V_{TN}\,\alpha_2) = \frac{R_2}{R_1 + R_2}(V_{TD}\,\alpha_1)$$

Therefore, appropriate values of $R_1$ and $R_2$ can be chosen to satisfy this condition for any given process. In practice, the terms $V_{TN}\alpha_2$ and $V_{TN}\alpha_1$ are typically near equal, such that resistor values of $R_1 \approx R_2$ can achieve zero temperature coefficient.

For further appreciation of the voltages appearing in various nodes in the circuit of FIG. 1, the following table is provided in which the left hand column indicates the baseline threshold voltages for N-channel, P-channel and depletion mode devices, as well as polycrystalline silicon resistance; and the right hand column indicates the corresponding temperature coefficients for each of the elements in the left hand column.

| | Typical Absolute Values | Approximate Temperature Coefficients |
|---|---|---|
| $V_{TN0}$ | +0.9 v | −0.000944 parts/C.° |
| $V_{TP0}$ | −0.9 v | −0.001666 parts/C.° |
| $V_{TD0}$ | −2.5 v | +0.000368 parts/C.° |
| Poly R0 | 25 ohms/□ | +0.00085 parts/C.° |

The above noted threshold voltage and polysilicon resistance absolute values and the temperature coefficients are exemplary values representative of typical present day CMOS processes. Both the absolute value and temperature coefficients are subject to variation based on the processes utilized in producing the devices.

Utilizing these exemplary values, and choosing R1=27KΩ and R2=25KΩ provides:

$$\frac{R_1}{R_1 + R_2} \approx 0.519$$

$$\frac{R_1}{R_1 + R_2} \approx 0.481$$

so, $$V_{REF} = 0.519\,(0.9) - 0.481\,(-2.5) = 1.67\ V$$

with a temperature coefficient of:

-continued $$V_{REF}\text{tempco} = [0.519\,(0.9)(-0.000944)] - [0.481(-2.5)(0.000368)]\,V/\text{C.}^\circ = 1.5\ \mu V/\text{C.}^\circ \approx 0$$

Returning to FIG. 1, tuning circuit 3 which is connected to node N2, thereby receiving voltage reference $V_{REF}$, permits the achievement of final output voltage $V_{REF}$ at node N4, and based on which of the switches SWA through SWN are closed, provides $V_{REF}$ with a predetermined relationship with respect to reference voltage $V_{REF}$. Tuning circuit 3 provides optimization of the reference voltage at node N4 which permits tailoring for process variations and also the ability to provide $V_{REF}$ greater than $VV_{REF}$.

Tuning circuit 3 utilizes operational amplifier 6 in conjunction with a voltage divider which is comprised of impedances RA, RB, RC through RN. As will be appreciated by reference to FIG. 1, the positive input terminal of operational amplifier 6 is connected to the node N2, the negative input terminal of operational amplifier 6 is connected to node N6 and output terminal 7 of operational amplifier 6 is connected to node N5. The inclusion of impedances RA through RN, along with switches SWA through SWN allows a tailoring of the voltage which will be provided at node N4. As pointed out above, this also permits the provision at node N4 of a voltage $VV_{REF}$ which is greater than, equal to, or less than reference voltage $VV_{REF}$. The impedance values assigned to impedances RA through RN are left to the selection of the user and no particular values are required. Additionally, impedance RA could alternatively be divided into smaller increments and include for each incremental portion of the impedance a switch to provide smaller variations of output voltage $VV_{REF}$ at small increments above $VV_{REF}$.

Due to the well understood principles of operation of an operational amplifier, the voltage at node N6 will be equal to $VV_{REF}$. Accordingly, if switch SWB is closed, then $VV_{REF}$ would be equal to $VV_{REF}$. If switch SWA is closed, then the output voltage at node N4 (providing $VV_{REF}$) would be equal to the voltage at node N5. The voltage at node N4 may be reduced below input voltage $VV_{REF}$ by closing any one of the switches SWC, SWN or SWN.

The following formula illustrates how $VV_{REF}$ may exceed $VV_{REF}$ by selecting switch SWA.

$$V_{N5} = V_{REF}\left(1 + \frac{RA}{(RB + RC + \ldots + RN)}\right) \quad [12]$$

Figure 4:
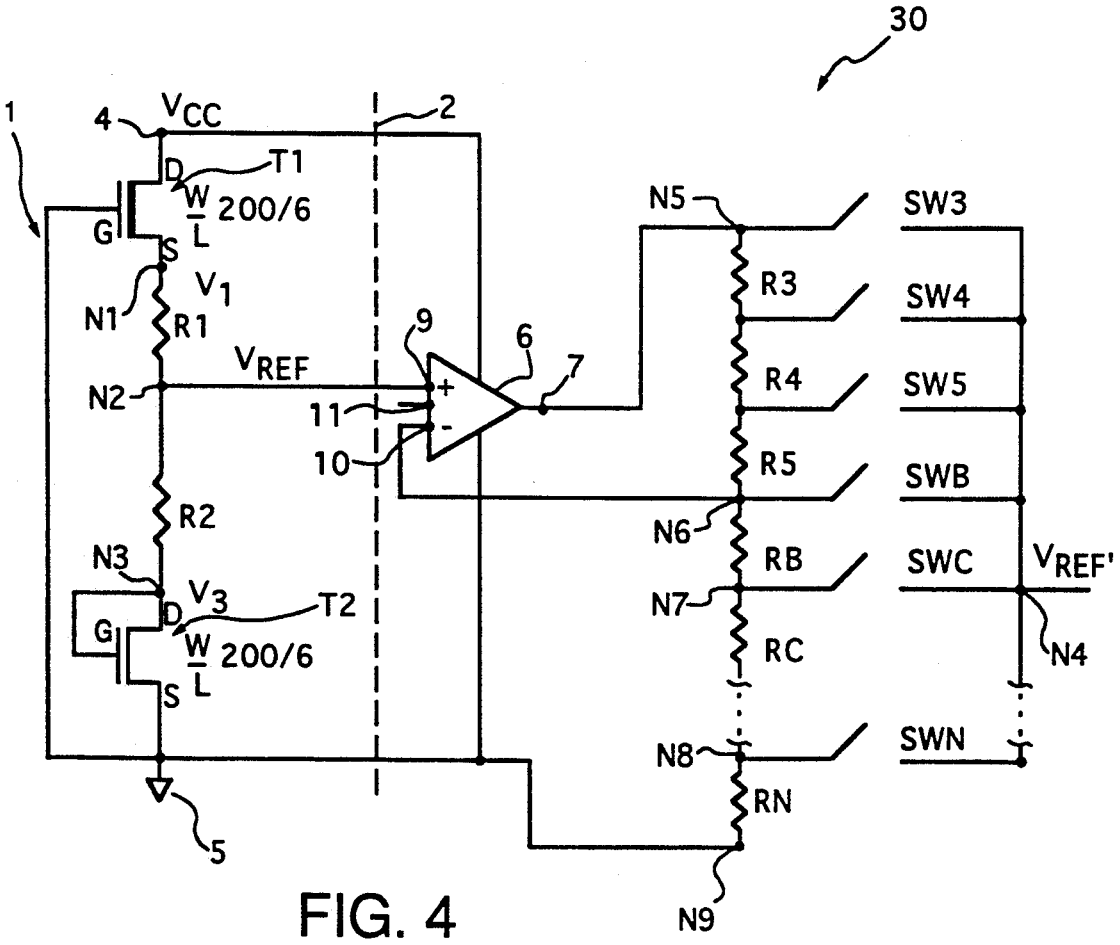
FIG. 4 is a circuit diagram of another embodiment of a voltage reference circuit in accordance with the present invention.

The output voltage at node N4 may be adjusted more finely above input voltage $VV_{REF}$ by utilizing additional impedances between the output terminal of operational amplifier 6 and the negative input terminal 10 of operational amplifier 6. Such a circuit is illustrated in FIG. 4, in which circuit elements which are common to those shown in FIG. 1 are indicated by the same reference character utilized in FIG. 1. Referring to FIG. 4, tuning circuit 30 provides the ability to include finer, incremental upward adjustments of the magnitude of output voltage appearing at node N4 above the input voltage $VV_{REF}$. As illustrated in FIG. 4, this may be achieved by providing impedances R3, R4 and R5 with their respective switches SW3, SW4 and SW5. The value of impedances R3, R4 and R5 are appropriately selected to provide the desired small incremental increase to the voltage $V_{REF}$ applied at node N4 over the reference input voltage $V_{REF}$. In practice, it is typically desired that the amount of impedance in between node N6 and N9 would be substantially greater than the impedance value between node N5 and N6.

Switches SWA through SWN are preferably implemented with low impedance (with respect to the input impedance of the stage or stages connected to node N4) pass gates controlled by EEPROM cells, hereinafter $E^2$ cells, so that they may be selectively reversibly opened and closed.

Figure 3:
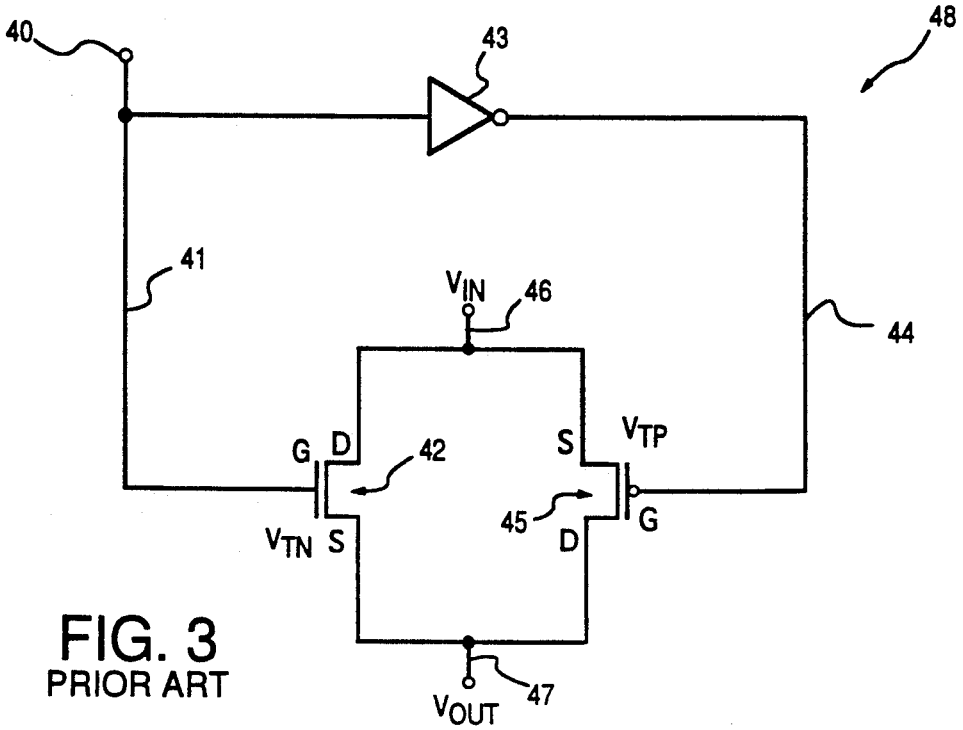
FIG. 3 PRIOR ART
FIG. 3 is a schematic diagram of a pass gate circuit which may be used in practicing the present invention.

FIG. 3 illustrates a typical pass gate 48 well-known in the art. A control signal provided on node 40, is applied to the gate G of N-channel transistor 42 via line 41. Inverter 43 inverts this signal, and transfers the new signal to the gate G of P-channel transistor 45 via line 44. This configuration ensures that both transistors 42 and 45 are both "on" or both "off". If transistors 42 and 45 are "on", then the output voltage $V_{OUT}$, is equal to $V_{IN}$. On the other hand, if transistors 42 and 45 are "off", then $V_{OUT}$ is not driven by $V_{IN}$ (the switch becomes a high impedance). When using a pass gate circuit, such as passgate 48, for switches SWA-SWN, the $V_{IN}$ terminal is connected to the associated node from which voltage is to be taken, and the VOUT terminal is connected to node N4.

Using EEPROM cells to control switches SWA-SWN enables the user to program and reprogram tuning circuit 3 to select the magnitude of the voltage which will appear at node N4. Moreover, EEPROM cells do not require special processing to obtain good performance from a standard process. Other programmable elements which may be used to control switches SWA-SWN include: erasable programmable read-only memory cells, static random access memory cells, polysilicon fuses, antifuses, or laser-trimmed elements. Note that the resistance of the pass gates that act as switches SWA-SWN are made negligible when compared to the input impedance of the stage or stages connected to node N4. Furthermore, at most, only one switch is closed at any one time.

Switches SWA through SWN could also be implemented using fusible links, in which case they would be normally closed as manufactured, and all but one would be opened in the process of tuning to determine the output voltage to be provided at node N4. In the preferred embodiment, impedances RA through RN would be implemented using any convenient resistor material in the process. The temperature coefficient of the output voltage of tuning circuit 3 depends only upon the temperature coefficient of the input voltage to the tuning circuit 3 and is independent of the temperature coefficient of resistor RA-RN within the constraint that *all* resistors RA-RN have an equal temperature coefficient. This is easily obtained, in practice, with nearly any available resistor material. Thus, the means for varying the impedance of the output voltage divider may take several forms.

Figure 2:
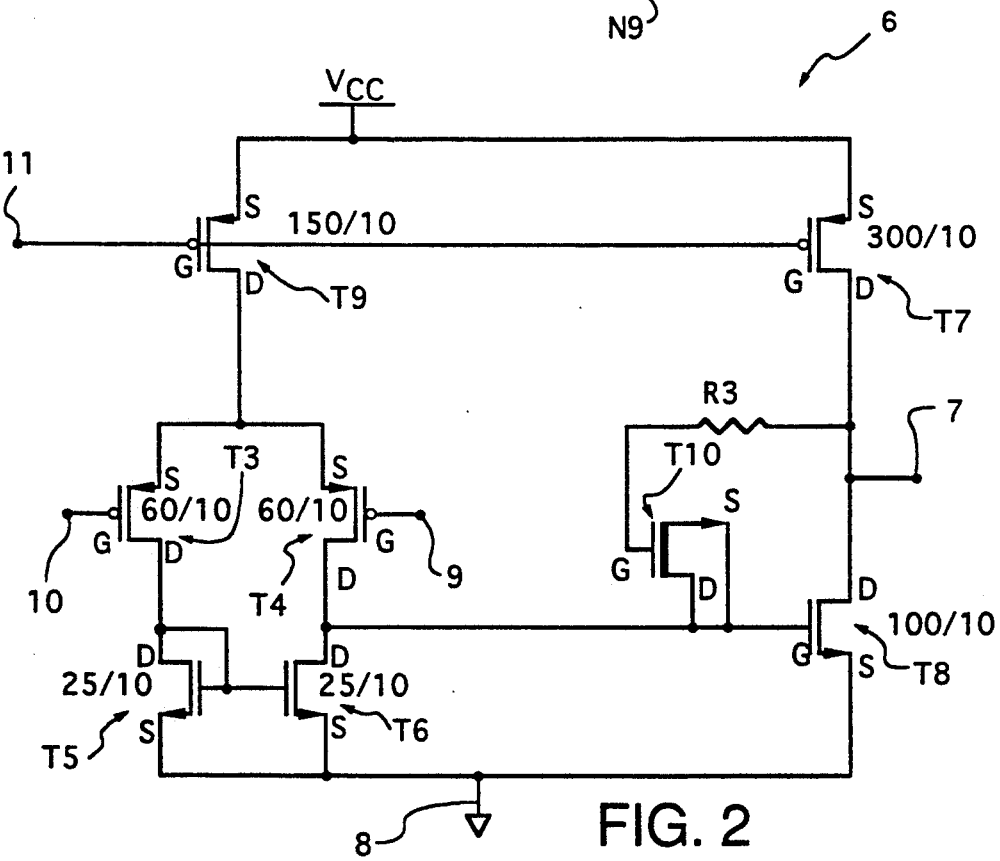
FIG. 2 PRIOR ART
FIG. 2 is a circuit diagram of an operational amplifier which may be used in practicing the present invention.

First operational amplifier 6 may be implemented using a circuit as set forth in FIG. 2 which illustrates the schematic of a operational amplifier preferable for use with the present invention. Negative input terminal 10 of operational amplifier 6 is connected to the gate of P-channel transistor T3 and positive input terminal 9 of operational amplifier 6 is connected to the gate of P-channel transistor T4. The input circuit of operational amplifier 6 further includes N-channel transistor T5 and N-channel transistor T6 which are connected to P-channel transistors T3 and T4 respectively. The source terminals of transistors T5 and T6 are connected to the second power supply terminal 5 via conductor 8. The output circuit for operational amplifier 6 includes P-channel transistor T7 and N-channel transistor T8, with the output terminal 7 being connected to the commonly connected drains of transistors T7 and T8. A suitable bias voltage from a source (not shown) is applied to terminal 11 which is connected to the gates of P-channel transistors T7 and T9. The source terminals of transistors T7 and T9 are commonly connected, and the common connection is connected to positive supply voltage $V_{CC}$. The output circuit for operational amplifier 6 includes a frequency stabilization network comprised of resistor R3 and depletion mode transistor T10. As is well known to those skilled in the art, a depletion mode transistor with commonly connected source and drain (as shown for T10), functions as a capacitor. Resistor R3 couples the gate of transistor T10 to the commonly connected drains of transistors T7 and T8. The channel width to length ratio which is preferred for the transistors in operational amplifier 6 are indicated adjacent to each of the transistors. Operational amplifier 6 operates in a fashion well known to those skilled in the art and the explanation of its operation is accordingly not necessary.

The foregoing illustrates the preferred embodiment of the present invention, however it will be appreciated by those skilled in the art that many variations may be made without departing from the spirit and scope of the invention and that the scope of the invention is governed by the following claims.

I claim:

1. A voltage reference circuit for providing a reference voltage with a predetermined temperature coefficient at an output terminal from a supply voltage, said voltage reference circuit comprising:

first and second supply voltage terminals for the application thereto of said supply voltage;

a first reference voltage output terminal;

a first semiconductor element having a first terminal, a second terminal, and a control terminal, the first and second terminals defining a main current carrying path, said first semiconductor element producing a first voltage having a non-zero temperature coefficient at the second terminal thereof, which is independent of variations in the magnitude of said supply voltage;

means connecting said first terminal of said first semiconductor element to said first supply voltage terminal;

means connecting said control terminal of said first semiconductor element to said second supply voltage terminal;

a first impedance having first and second terminals;

means connecting said first terminal of said first impedance to said second terminal of said first semiconductor element;

means connecting said second terminal of said first impedance to said reference voltage output terminal;

a second semiconductor element having a first terminal, a second terminal, and a control terminal, the first and second terminals defining a main current carrying path, said second semiconductor element producing a second voltage having a non-zero temperature coefficient at the second terminal thereof, which is independent of variations in the magnitude of said supply voltage;

means connecting said first terminal of said second semiconductor element to said second supply voltage terminal;

means connecting said control terminal of said second semiconductor element to a potential that biases said second semiconductor element in a slightly on mode;

a second impedance having first and second terminals;

means connecting said first terminal of said second impedance to said reference voltage output terminal; and means connecting said second terminal of said second impedance to said second terminal of said second semiconductor element.

2. A voltage reference circuit according to claim 1, wherein the temperature coefficient of the voltage produced by one of said first and second semiconductor elements is positive and the temperature coefficient of the voltage produced by the other of said first and second semiconductor elements is negative.

3. A voltage reference circuit according to claim 1, wherein:

said first semiconductor element comprises a depletion mode field effect transistor having a drain terminal, a source terminal and a gate terminal, and further wherein said first, second, and control terminals of said second semiconductor element correspond to the source, drain, and gate terminals respectively of said enhancement mode field effect transistor.

4. A voltage reference circuit according to claim 1, wherein:

said second semiconductor element comprises an enhancement mode field effect transistor having a drain terminal, a source terminal and a gate terminal, and further wherein said first, second, and control terminals of said second semiconductor element correspond to the source, drain, and gate terminals respectively of said enhancement mode field effect transistor; and wherein said means connecting said gate terminal of said second semiconductor element connects said gate terminal of said enhancement mode field effect transistor to said drain terminal of said enhancement mode field effect transistor.

5. A voltage reference circuit according to any of claims 2–4, wherein said first and second impedances are selected to provided a constant reference voltage with zero temperature coefficient at said first reference voltage output terminal.

6. A voltage reference circuit according to any of claims 1–4 further comprising: an operational amplifier having a positive input terminal, a negative input terminal and an output terminal; means connecting said reference voltage output terminal to said positive input terminal of said operational amplifier; a first output impedance having first and second terminals; a second reference voltage output terminal; means connecting said output terminal of said operational amplifier to said first terminal of said first output impedance; a second output impedance having first and second terminals, and means connecting in common said first terminal of said second output impedance and said second terminal of said first output impedance, and means connecting said second terminal of said second output impedance to said second supply voltage terminal; means connecting said negative input terminal of said operational amplifier to said second terminal of said first output impedance; a first switch means coupled between said first terminal of said first output impedance and said second reference voltage output terminal for selectively connecting said output terminal of said operational amplifier to said second reference voltage output terminal; and a second switch means coupled between said second terminal of said first output impedance and said second reference voltage output terminal for selectively connecting said negative input terminal of said operational amplifier to said reference voltage output terminal

7. A voltage reference circuit according to claim 5 further comprising: an operational amplifier having a positive input terminal, a negative input terminal and an output terminal; means connecting said reference voltage output terminal to said positive input terminal of said operational amplifier; a first output impedance having first and second terminals; a second reference voltage output terminal; means connecting said output terminal of said operational amplifier to said first terminal of said first output impedance; a second output impedance having first and second terminals, and means connecting in common said first terminal of said second output impedance and said second terminal of said first output impedance, and means connecting said second terminal of said second output impedance to said second supply voltage terminal; means connecting said negative input terminal of said operational amplifier to said second terminal of said first output impedance; a first switch means coupled between said first terminal of said first output impedance and said second reference voltage output terminal for selectively connecting said output terminal of said operational amplifier to said second reference voltage output terminal; and a second switch means coupled between said second terminal of said first output impedance and said second reference voltage output terminal for selectively connecting said negative input terminal of said operational amplifier to said reference voltage output terminal.

8. A voltage reference circuit according to claim 6, wherein said first switch means and said second switch means each comprise a CMOS transistor pass gate switch, each of said pass gate switches having first and second terminals defining a conduction path, and a control terminal for receiving a signal for controlling the conduction of said pass gate switch.

9. A voltage reference circuit according to claim 7, wherein said first switch means and said second switch means each comprise a CMOS transistor pass gate switch, each of said pass gate switches having first and second terminals defining a conduction path, and a control terminal for receiving a signal for controlling the conduction of said pass gate switch.

10. A voltage reference circuit according to claim 8, wherein said voltage reference circuit further includes programmable circuit means connected to said control terminal of said CMOS transistor pass gate switch whereby the conduction state of said pass gate switch is controlled in response to a signal applied to said control gate by said programmable circuit means.

11. A voltage reference circuit according to claim 9, wherein said first switch means and said second switch means each comprise a CMOS transistor pass gate switch, each of said pass gate switches having first and second terminals defining a conduction path, and a control terminal for receiving a signal for controlling the conduction of said pass gate switch.

12. A voltage reference circuit according to claim 10, wherein said programmable circuit means comprises a electrically programmable read only memory device.

13. A voltage reference circuit according to claim 11, wherein said programmable circuit means comprises an electrically programmable read only memory device.

14. A voltage reference circuit according to claim 10, wherein said programmable circuit means comprises an electrically erasable and programmable read only memory device.

15. A voltage reference circuit according to claim 11, wherein said programmable circuit means comprises an electrically erasable and programmable read only memory device.

16. A voltage reference circuit according to claim 10, wherein said programmable circuit means comprises a static random access memory device.

17. A voltage reference circuit according to claim 11, wherein said programmable circuit means comprises an static random access memory device.

18. A voltage reference circuit according to claim 6, wherein said programmable circuit means comprises a polysilicon fuse element.

19. A voltage reference circuit according to claim 7, wherein said programmable circuit means comprises a polysilicon fuse element.

20. A voltage reference circuit according to claim 10, wherein said programmable circuit means comprises an antifuse element.

21. A voltage reference circuit according to claim 11, wherein said programmable circuit means comprises an antifuse element.

22. A voltage reference circuit according to claim 10, wherein said programmable circuit means comprises a laser programmed fuse element.

23. A voltage reference circuit according to claim 11, wherein said programmable circuit means comprises a laser programmed fuse element.

24. A voltage reference circuit according to any of claims 3 or 4, wherein the temperature coefficient of the voltage produced by one of said first and second semiconductor elements is positive and the temperature coefficient of the voltage produced by the other of said first and second semiconductor elements is negative.

* * * * *